US006227020B1

(12) United States Patent
Lerchner

(10) Patent No.: US 6,227,020 B1
(45) Date of Patent: May 8, 2001

(54) LOCKING DEVICE

(75) Inventor: Leonhard Lerchner, Salzburg (AT)

(73) Assignee: Keso GmbH, Salzburg (AT)

( * ) Notice: Subject to any disclaimer, the term of this patent is extended or adjusted under 35 U.S.C. 154(b) by 0 days.

(21) Appl. No.: 09/403,706

(22) PCT Filed: Feb. 18, 1999

(86) PCT No.: PCT/EP99/01019

§ 371 Date: Oct. 22, 1999

§ 102(e) Date: Oct. 22, 1999

(87) PCT Pub. No.: WO99/42688

PCT Pub. Date: Aug. 26, 1999

(30) Foreign Application Priority Data

Feb. 23, 1998 (DE) ..... 198 07 577

(51) Int. Cl.[7] ..... E05B 49/02

(52) U.S. Cl. ..... 70/278.3; 70/278.7; 70/283.1; 70/417; 70/453

(58) Field of Search ..... 70/277, 278.1, 70/278.2, 278.3, 278.7, 279.1, 282, 283, 283.1, 417, 453, 454

(56) References Cited

U.S. PATENT DOCUMENTS

| | | | | |
|---|---|---|---|---|
| 3,795,123 | * | 3/1974 | Stiffel | 70/417 |
| 4,073,172 | * | 2/1978 | Schlage | 70/417 |
| 5,373,718 | * | 12/1994 | Schwerdt et al. | 70/278.3 |
| 5,542,274 | * | 8/1996 | Thordmark et al. | 70/283 X |
| 5,561,997 | * | 10/1996 | Milman | 70/283 |
| 5,699,686 | * | 12/1997 | Neumayer et al. | 70/276 X |
| 5,986,563 | * | 11/1999 | Shapiro | 340/825.31 |

FOREIGN PATENT DOCUMENTS

| | | | | |
|---|---|---|---|---|
| 3921893 | * | 1/1990 | (DE) | 70/278.3 |
| 42 07 161 | | 9/1993 | (DE) . | |
| 195 17 728 | | 11/1996 | (DE) . | |
| 196 53 113 | | 6/1997 | (DE) . | |
| 297 03 063 U | | 6/1997 | (DE) . | |
| 730 073 | | 9/1996 | (EP) . | |
| 838 568 | | 4/1998 | (EP) . | |
| 2 520 791 | | 8/1983 | (FR) . | |
| 2556765 | * | 6/1985 | (FR) | 70/278.2 |
| 2187227 | * | 9/1987 | (GB) | 70/278.3 |
| 2225371 | * | 5/1990 | (GB) | 70/278.3 |
| 402020779 | * | 1/1990 | (JP) | 70/278.2 |
| 403140577 | * | 6/1991 | (JP) | 70/454 |
| 404011179 | * | 1/1992 | (JP) | 70/278.3 |

* cited by examiner

*Primary Examiner*—Lloyd A. Gall
(74) *Attorney, Agent, or Firm*—Flynn, Thiel, Boutell & Tanis, P.C.

(57) ABSTRACT

A locking device including at least one key and a lock cylinder having at least one cylinder core pivotally mounted in a cylinder housing and having a keyway is provided with a blocking element which in its blocked position prevents rotation of the cylinder core with the key, and in its release position permits rotation of the cylinder core with the key. Further provided are an actuator which blocks the blocking element in the blocked position and releases it in the release position, and an electronic code transmitter in the key and an electronic code evaluator which controls the actuator. The lock cylinder is provided with a cylinder armor having an armor housing covering the cylinder housing and an armor disk pivotally mounted therein with a key insertion slot flush with the keyway of the cylinder core. The blocking element and the actuator are disposed in the armor housing. In its blocked position the blocking element acts on the armor disk so as to prevent rotation, releasing it in the release position.

11 Claims, 2 Drawing Sheets

LOCKING DEVICE

FIELD OF THE INVENTION

This invention relates to a locking device with an electronically coded key.

BACKGROUND OF THE INVENTION

Such a locking device is known from DE 195 17 728 A1. The lock cylinder is provided with a cylinder sack for receiving the actuator formed as an electric motor. The keyway is open toward the circumferential surface of the cylinder core. The blocking element is formed as a stirrup engaging at its two ends two recesses in the circumferential surface of the cylinder core on either side of the open keyway in the axial area of the cylinder core provided with mechanical tumblers. The actuator formed as an electric motor and disposed in the cylinder sack has a shaft with two opposite cams acting on the stirrup or the cylinder housing in the blocked position.

The known locking device with an electronically and mechanically coded key has proven useful by and large. However, one must replace the total cylinder lock. Also, one can only retrofit cylinder locks with a cylinder sack with this locking device.

DE 42 07 161 A1 discloses a locking device with a lock cylinder wherein an additional electronic lock in the form of an additional cover is provided. The latter contains a cap rotating with the cylinder core.

DE 297 03 063 U1 discloses an additional electromagnetic lock for the cylinder core, said lock engaging recesses on the circumference of the cylinder core.

Further, DE 196 53 113 A1 describes the formation of an annular coil as an antenna for data transmission with a cylinder lock having additional electronic protection.

The problem of the invention is to change over virtually all cylinder locks to such a locking device with electronic, in particular electronic and mechanical, coding without having to replace them.

SUMMARY OF THE INVENTION

The security of lock cylinders frequently leaves something to be desired. For example they can be picked by turning a screw into the keyway or by other picking tools. For better protection of lock cylinders one therefore provides them with a so-called cylinder armor consisting of a massive armor housing placed on the lock cylinder and having a massive armor disk with a key insertion slot pivotally mounted therein. Armor housing and armor disk are made of a hard steel, e.g. nickel chromium steel.

The invention is only based on the idea of controlling access to the keyway in the cylinder core with the armor disk by the electronic coding of the key. The lock cylinder is provided with such a cylinder armor according to the invention for this purpose. The cylinder armor contains in the armor housing the actuator and the blocking element to be operated thereby, in an arrangement such that it acts on the armor disk so as to prevent rotation in the blocked position and release the armor disk in its release position.

That is, the armor disk prevents access to the keyway in the cylinder core with a screw or similar picking tool as in a conventional cylinder armor. At the same time, however, the armor disk has the function of permitting rotation of the cylinder core only if the key has the correct electronic coding.

The blocking element preferably engages a recess on the circumference of the armor disk. It is preferably spring-loaded to its blocked position. The force for engaging the blocking element in the blocked position, i.e. in the recess in the circumference of the armor disk, is thus applied by the spring. Disengagement of the blocking element from the recess in the armor disk, i.e. release of the armor disk rotation, is effected by the manual force during rotation of the key inserted into the cylinder core.

In order to facilitate disengagement one can provide sliding surfaces or roll bodies, for example a ball or roller, on the blocking element or in the recess. In the blocked position the blocking element thus opposes forcible rotation of the armor disk with a high shear force. On the other hand, it slides or rolls out of the recess and then over the circumference of the armor disk when the cylinder core is rotated with the key.

The actuator can be an electromagnet for example. However it is preferably formed by an electric motor which moves a member preferably acting on both the blocking element and the armor housing in the blocked position. The actuator is thus bistable. That is, the electric motor has a currentless state in both the blocked position and the release position of the armor disk.

The member moved by the electric motor can be the nut of a worm gear which is displaceable in the armor housing and engaged by a thread on the motor shaft. It is also possible to form the member for example as an eccentric on the camshaft with two opposite cams, the two cams being supported on the blocking element or the armor housing in the blocked position of the armor disk.

Since displacement of the blocking element to the blocked position is effected by the abovementioned spring, while the force for displacing the blocking element to the release position is applied manually during rotation of the cylinder core, one can use a very small motor, which can be accommodated within the armor housing in space-saving fashion.

Also, its power consumption is low. For supplying power to the actuator or motor one can provide a battery which can be mounted in the door. However, the power supply unit is preferably also integrated in the cylinder armor, for example a button battery provided in the armor housing. The code evaluator can be disposed in the armor housing as well.

The essential advantage of the invention is thus that the lock cylinder already present in the door can remain completely unchanged since one need only place the cylinder armor with the blocking element and actuator and optionally the electronic code evaluator and the power supply unit on the lock cylinder on the endangered side, i.e. the outside, and fasten it thereto.

The cylinder armor can be dimensioned so as to fit almost any lock cylinder. It is thus independent of the make. That is, virtually all lock cylinders, for example Europrofile, round or oval cylinders, can be retrofitted anytime by a very simple mounting operation according to the invention.

Both cylinder locks with one cylinder core and double cylinder locks with two cylinder cores can evidently be retrofitted according to the invention. In the latter case the cylinder core is provided with the inventive cylinder armor on the endangered side, for example the outside of a door.

The cylinder core on the inside of the door is then unlockable only by the mechanical coding of the key.

According to the invention the key can be coded only electronically. However, since conventional lock cylinders with mechanical tumblers are normally provided with the inventive cylinder armor, electronic coding is generally only a code in addition to the mechanical code of the key.

The electronic code transmitter in the key is preferably formed by a transponder, and the electronic code evaluator in the cylinder armor preferably by a transponder reading device. The key preferably has a ferrite antenna for this purpose. If it is formed as a reversible key, two ferrite antennas are provided, one on either side of the key bow. The arrangement of the ferrite antennas on the armor housing and on the key is such that only a narrow air gap arises between the ferrite antenna in the armor housing and the ferrite antenna of the key when the key is inserted in the lock cylinder so that low energy losses occur upon transmission.

The transponder reading device comprises a microprocessor and a nonvolatile memory. Further, a clock is generally provided for the date and time function with a quartz oscillator as a time base. The actuator is driven directly by the microprocessor.

When the key is removed, i.e. the ferrite antenna of the key moves away from the ferrite antenna in the armor housing, the blocking element displaces the actuator to the blocked position. Upon rotation of the key inserted in the lock cylinder, however, the ferrite antenna of the key also moves away from the ferrite antenna in the armor housing. That is, if no additional measures were taken the actuator would be operated upon rotation of the lock cylinder; it would try to push the blocking element into the blocked position.

In order to prevent this, i.e. to leave the actuator unoperated upon rotation of the key, one can provide a rotation sensor, for example a piezoelectric element or a switch for detecting the rotary position of the armor disk or cylinder core. Since the blocking element is in the release position upon rotation of the armor disk or cylinder core, the switch is preferably formed so as to be operated by the blocking element when the latter is in the release position.

The terms "lock cylinder," "cylinder housing," "cylinder core," "keyway" and "key" are to be interpreted broadly according to the invention. For example, the invention also includes pivotally mounted drivers in a housing if the driver has a recess, e.g. a polygonal inside recess, in which one can insert a key-like tool, e.g. a polygonal one. The armor housing can also be formed by an armature part.

BRIEF DESCRIPTION OF THE DRAWINGS

In the following, various embodiments of the inventive locking device will be explained in more detail by way of example with reference to the drawing, in which.

DETAILED DESCRIPTION OF THE INVENTION

Figure 1:
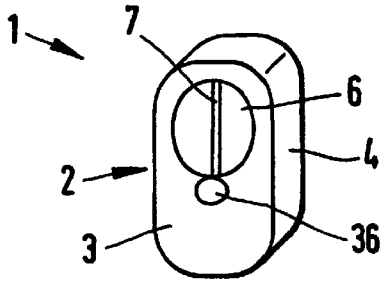
FIG. 1 shows a perspective view of a cylinder armor according to an embodiment of the invention.

According to FIG. 1, cylinder armor 1 consists of armor housing 2 with end wall 3 and circumferential wall 4. Pivotally mounted in a bore in end wall 3 is armor disk 6 having key insertion slot 7. Housing 2 and disk 6 are made of steel several millimeters thick, e.g. nickel chromium steel.

Figure 2:
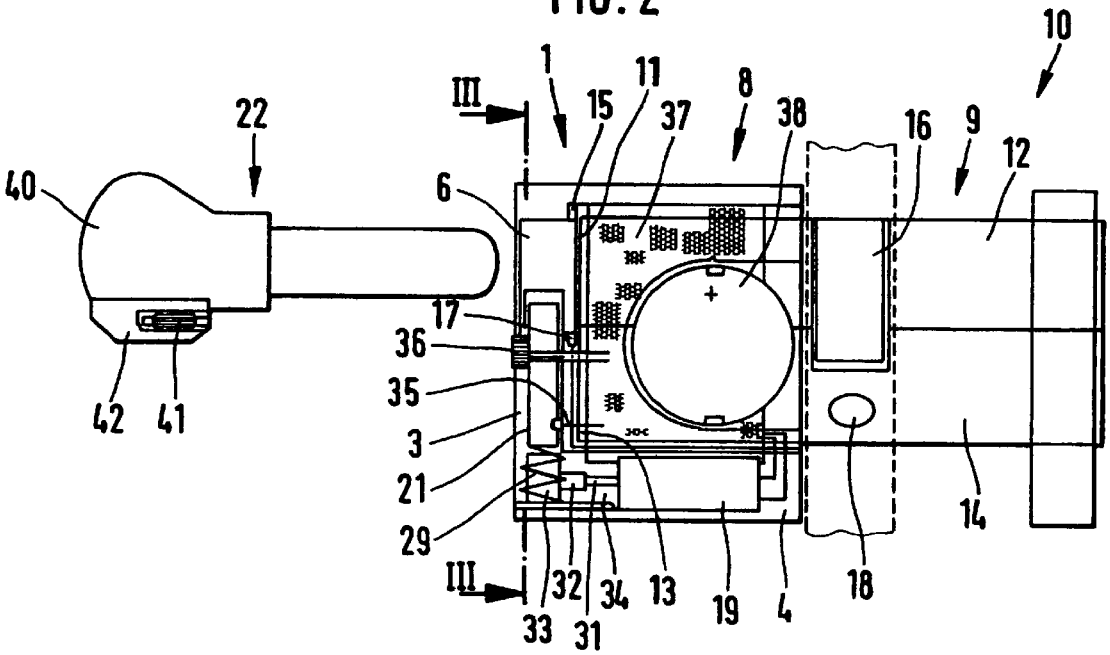
FIG. 2 shows a longitudinal section through a lock cylinder with the cylinder armor according to FIG. 1 in the blocked position.

FIG. 2 shows double cylinder lock 10 with two cylinder housing half-members 8, 9 in which cylinder cores 11, 12 are pivotally mounted, respectively. Each cylinder housing half-member 8, 9 is provided with cylinder sack 13, 14. Between cylinder housing half-members 8, 9 there is a recess for locking beard 16 which is connected with cylinder cores 11 and 12 so as to rotate in unison with a coupling not shown. Bore 18 serves to fasten double cylinder lock 10 to the door with a screw.

Cylinder armor 1 is set on cylinder housing half-member 8 disposed e.g. on the outside of the door, so that the face and the circumference of cylinder housing half-member 8 are covered by cylinder armor 1. Cylinder armor 1 is fastened to cylinder housing half-member 8, such that key insertion slot 7 is flush with the keyway of the (unoperated) cylinder core. Armor disk 6 is secured against extraction by ring shoulder 15 disposed in ring groove 17 on the inside of end wall 3 of armor housing 2.

Electric motor 19 as an actuator is disposed in circumferential wall 4 of cylinder armor 1 in a corresponding longitudinal receiving means on the inside of the lower side facing away from armor disk 6. Blocking element 21 is mounted in a corresponding guide on the inside of end wall 3 of cylinder armor 1 so as to be displaceable radially back and forth.

Figure 3:
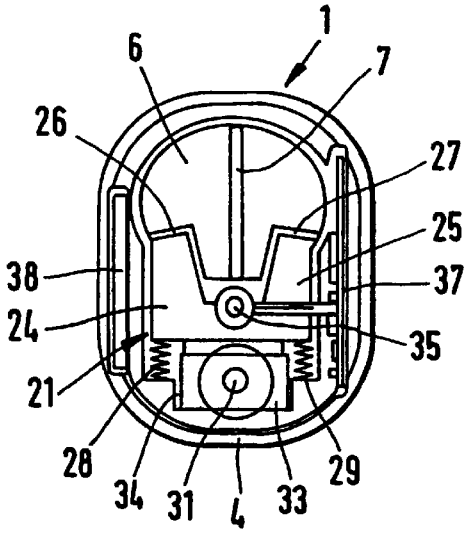
FIG. 3 shows a cross section along line III—III in FIG. 2.
Figure 4:
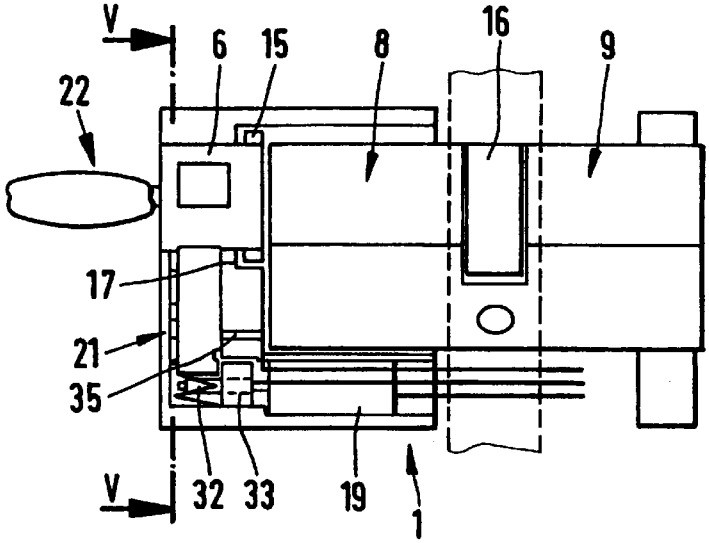
FIG. 4 shows a longitudinal section through another embodiment in the release position.
Figure 5:
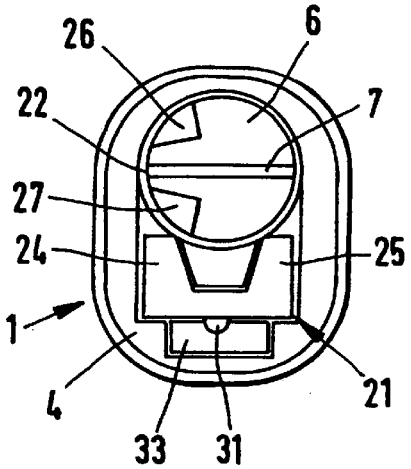
FIG. 5 shows a cross section along line V—V in FIG. 4.

In its blocked position shown in FIGS. 2 and 3 blocking element 21 prevents rotation of armor disk 6, while in the release position shown in FIG. 5 it permits rotation of armor disk 6. Blocking the rotation of armor disk 6 according to FIGS. 2 and 3 at the same time prevents rotation of cylinder core 11 with key 22, thereby blocking lock 10, while when armor disk 6 is released to rotate according to FIGS. 4 and 5 cylinder core 11 can be rotated and lock 10 thus opened, provided the depressions or other mechanical codings (not shown) of key 22 move the tumblers (not shown) of cylinder lock 10 into the release position.

Blocking element 21 is formed as a stirrup with two ends 24, 25 engaging two recesses 26, 27 on the circumference of armor disk 6 on either side of key insertion slot 7, blocking element or stirrup 21 being loaded by springs 28, 29 to the engaged position (FIG. 3).

Motor shaft 31 of electric motor 19 is provided with thread 32 engaging nut 33 mounted displaceably in corresponding longitudinal recess 34 on the inside of cylinder armor 1 such that said nut is disposed between blocking element or stirrup 21 and circumferential wall 4 of cylinder armor 1 in the blocked position according to FIGS. 2 and 3, while being displaced toward electric motor 19 such that blocking element or stirrup 21 is displaceable radially away from armor disk 6 against the force of springs 28, 29 in the release position according to FIGS. 4 and 5.

That is, in the release position shown in FIGS. 4 and 5 rotation of key 22 inserted into cylinder core 11 causes ends 24, 25 of stirrup 21 to be urged out of recesses 26, 27 in armor disk 6 against the force of springs 28, 29, whereupon cylinder core 11 is freely rotatable.

Rotation sensor 35 is disposed in end wall 3 of armor housing 2 for detecting the position of blocking element 21 and thus preventing electric motor 19 from being operated upon rotation of armor disk 6 after release of armor disk 6.

According to FIGS. 1 to 3, ferrite antenna 36 is disposed in a corresponding bore on end wall 3 of armor housing 2. Antenna 36 is connected to electronic code evaluator 37, for example a transponder reading device, which is disposed in a recess on the inside of circumferential wall 4 of armor housing 2. Power supply unit 38 is formed by a button battery disposed in a recess on the inside of circumferential wall 4 of cylinder housing 2 on the side opposite code evaluator 37.

Key 22 is provided on bow 40 with ferrite antenna 41 which is connected to electronic module 42 containing the data carrier or code transmitter. Module 42 can be formed as a transponder.

The embodiment according to FIGS. 4 and 5 differs from that according to FIGS. 2 and 3 substantially in that the code evaluator and the power supply unit are disposed not in cylinder armor 1 but for example on the inside of the door.

Figure 6:
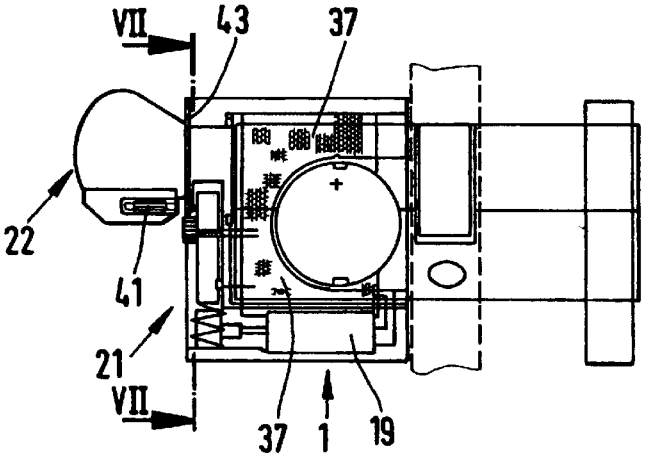
FIG. 6 shows a longitudinal section through another embodiment in the blocked position.
Figure 7:
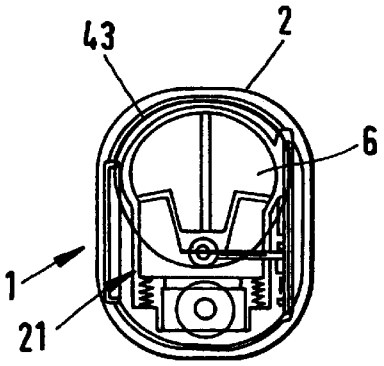
FIG. 7 shows a cross section along line VII—VII in FIG. 6.

In the embodiment according to FIGS. 6 and 7 the antenna connected to code evaluator 37 is formed as ring antenna 43 disposed concentrically around the bore for armor disk 6 on end wall 3 of armor housing 2. Ring antenna 43 has more power, i.e. not only a greater reach but also the advantage of faster data transmission and thus a shorter unlocking time. In addition, one can possibly do without rotation sensor 35 in this embodiment.

Figure 8:
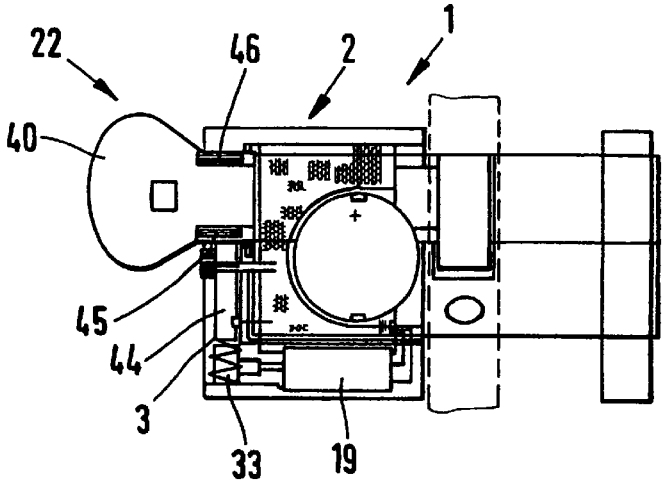
FIG. 8 shows a longitudinal section through yet another embodiment in the blocked position.

In the embodiment according to FIG. 8 ferrite antenna 44 is disposed in an inside recess in end wall 3, i.e. shifted inwardly and thus inaccessible from the outside. Key 22 is formed as a reversible key. Accordingly, one ferrite antenna 45, 46 is provided in the area of each narrow side of the key shaft, in that area of the shaft located in armor disk 6 when key 22 is inserted into the keyway of cylinder core 11.

What is claimed is:

1. A locking device comprising at least one key and a lock cylinder having at least one cylinder core or similar driver pivotally mounted in a cylinder housing and having a keyway, a blocking element which in its blocked position prevents rotation of the cylinder core with the key and in its release position permits rotation of the cylinder core with the key, an electric motor or an electromagnet for moving a member which acts on the blocking element in the blocked position and releases the blocking element in the release position, and an electronic code transmitter in the key and an electronic code evaluator which controls the electric motor or the electromagnet, wherein the lock cylinder is provided with a cylinder armor having an armor housing covering the cylinder housing and an armor disk pivotally mounted therein with a key insertion slot flush with the keyway of the cylinder core, the blocking element and the electric motor or electromagnet are disposed in the armor housing, and the blocking element in its blocked position acts on the armor disk and the armor housing so as to prevent rotation and in its release position releases the armor disk.

2. A locking device according to claim 1, wherein the blocking element in its blocked position engages at least one recess disposed on the circumference of the armor disk.

3. A locking device according to claim 1, wherein the blocking element is spring-loaded to its blocked position.

4. A locking device according to claim 1, wherein at least one of a power supply unit and the code evaluator is disposed in the armor housing.

5. A locking device according to claim 1, wherein the member is formed by a nut of a worm gear.

6. A locking device according to claim 1, wherein an antenna is provided in the armor housing for receiving the code information of the electronic code transmitter in the key.

7. A locking device according to claim 6, wherein the antenna for receiving the code information extends in the end wall of the armor around the armor disk as a ring antenna.

8. A locking device according to claim 6, wherein a second antenna is provided on the key in the area of the key shaft disposed in the armor disk when the key is inserted in the cylinder core.

9. A locking device according to claim 1, wherein the electronic code transmitter is formed by a transponder, and the electronic code evaluator by a transponder reading device.

10. A locking device according to claim 1, wherein a rotation sensor is provided in the armor housing for detecting the position of the blocking element for nonoperation of the elecric motor or the electromagnet upon rotation of the key.

11. A locking device comprising at least one key and a lock cylinder having at least one cylinder core or similar driver pivotally mounted in a cylinder housing and having a keyway, a blocking element which in its blocked position prevents rotation of the cylinder core with the key and in its release position permits rotation of the cylinder core with the key, an actuator for blocking the blocking element in the blocked position and releasing the blocking element in the release position, and an electronic code transmitter in the key and an electronic code evaluator which controls the actuator, wherein the lock cylinder is provided with a cylinder armor having an armor housing covering the cylinder housing and an armor disk pivotally mounted therein with a key insertion slot flush with the keyway of the cylinder core, the blocking element and the actuator are disposed in the armor housing, and the blocking element is formed as a stirrup engaging at its two ends two recesses on the circumference of the armor disk on either side of the key insertion slot, and in its blocked position acts on the armor disk so as to prevent rotation and in its release position releases the armor disk.

* * * * *

UNITED STATES PATENT AND TRADEMARK OFFICE

CERTIFICATE OF CORRECTION

PATENT NO. : 6,227,020 B1
DATED : May 8, 2001
INVENTOR(S) : Leonhard Lerchner

It is certified that error appears in the above-identified patent and that said Letters Patent is hereby corrected as shown below:

Column 6,
Line 28, change "elecric" to -- electric --.

Signed and Sealed this

Twelfth Day of March, 2002

*Attest:*

*Attesting Officer*

JAMES E. ROGAN
*Director of the United States Patent and Trademark Office*